US011562709B2

(12) United States Patent
Lee

(10) Patent No.: US 11,562,709 B2
(45) Date of Patent: Jan. 24, 2023

(54) METHOD, DEVICE AND SYSTEM FOR DETERMINING ACTUAL OPTION COMMON VOLTAGE OF DISPLAY PANEL

(71) Applicant: HKC CORPORATION LIMITED, Shenzhen (CN)

(72) Inventor: Chia-Hang Lee, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/271,580

(22) PCT Filed: Dec. 4, 2018

(86) PCT No.: PCT/CN2018/119181
§ 371 (c)(1),
(2) Date: Feb. 25, 2021

(87) PCT Pub. No.: WO2020/098014
PCT Pub. Date: May 22, 2020

(65) Prior Publication Data

US 2021/0350761 A1 Nov. 11, 2021

(30) Foreign Application Priority Data

Nov. 13, 2018 (CN) ..... 201811344810.3

(51) Int. Cl.
*G09G 3/20* (2006.01)
*G09G 3/36* (2006.01)
*G09G 3/00* (2006.01)

(52) U.S. Cl.
CPC ..... *G09G 3/3696* (2013.01); *G09G 3/006* (2013.01); *G09G 2320/0247* (2013.01)

(58) Field of Classification Search
CPC ..... G09G 3/3696; G09G 2320/0247; G09G 3/3655
See application file for complete search history.

(56) References Cited

U.S. PATENT DOCUMENTS 9,697,779 B2 7/2017 Lu et al.
2003/0055591 A1* 3/2003 Whittington ..... G09G 3/006 702/108

(Continued)

FOREIGN PATENT DOCUMENTS

CN 101615382 A 12/2009
CN 102081917 A 6/2011

(Continued)

OTHER PUBLICATIONS

Yuan Li, the ISA written comments, Aug. 2019, CN.
Yuan Li, the International Search Report, dated Aug. 2019, CN.

*Primary Examiner* — Jose R Soto Lopez

(57) ABSTRACT

The present application provides a method, a device and a system for determining an actual option common voltage of a display panel. The method for determining the actual option common voltage of the display panel includes the following steps: acquiring a first common voltage and a second common voltage for fitting a curve; acquiring a first flicker corresponding to the first common voltage and a second flicker corresponding to the second common voltage; acquiring a first Vcom-Flicker curve according to the first common voltage and the first flicker, and acquiring a second Vcom-Flicker curve according to the second common voltage and the second flicker; and determining a common voltage at an intersection of the first Vcom-Flicker curve and the second Vcom-Flicker curve, in which the common voltage at the intersection is the actual option common voltage.

5 Claims, 7 Drawing Sheets

(56) References Cited

U.S. PATENT DOCUMENTS

2005/0190172 A1* 9/2005 Koyama ..... G09G 3/3648 345/204
2006/0145986 A1* 7/2006 Oh ..... G09G 3/006 345/92
2006/0227273 A1* 10/2006 Shin ..... G02F 1/13624 349/139
2007/0057975 A1* 3/2007 Oh ..... G09G 3/3648 345/690
2007/0236484 A1* 10/2007 Oh ..... G09G 3/3614 345/204
2007/0291190 A1* 12/2007 Shin ..... G09G 3/3696 349/37
2008/0117148 A1* 5/2008 Tu ..... G09G 3/3655 345/87
2009/0262103 A1* 10/2009 Huang ..... G09G 3/3611 345/212
2013/0088476 A1* 4/2013 Yamagishi ..... G09G 3/3655 345/211
2013/0328755 A1 12/2013 Al-Dahle et al.
2014/0022225 A1* 1/2014 Lee ..... G09G 3/20 345/211
2015/0187290 A1* 7/2015 No ..... G09G 3/3607 345/694
2015/0213769 A1* 7/2015 Shin ..... G09G 3/3655 345/89
2015/0243229 A1* 8/2015 Jung ..... G09G 3/3688 345/690
2016/0300544 A1* 10/2016 Ding ..... G09G 3/006
2016/0351139 A1* 12/2016 Syu ..... G09G 3/2011
2018/0286304 A1* 10/2018 Park ..... G09G 3/22
2020/0160801 A1* 5/2020 Wang ..... G09G 3/36
2020/0320914 A1* 10/2020 Lee ..... G09G 3/006
2021/0097909 A1* 4/2021 Gangopadhyay .... G09G 3/3655

FOREIGN PATENT DOCUMENTS

CN 104347048 A 2/2015
CN 105511134 A 4/2016

* cited by examiner

METHOD, DEVICE AND SYSTEM FOR DETERMINING ACTUAL OPTION COMMON VOLTAGE OF DISPLAY PANEL

CROSS REFERENCE OF RELATED APPLICATIONS

The present application claims priority to the Chinese Patent Application No. 201811344810.3 entitled "METHOD, DEVICE AND SYSTEM FOR DETERMINING ACTUAL OPTION COMMON VOLTAGE OF DISPLAY PANEL" filed with the National Intellectual Property Administration, PRC on Nov. 13, 2018, which is incorporated herein by reference in its entirety.

TECHNICAL FIELD

The application relates to a method, a device and a system for determining an actual option common voltage of a display panel.

BACKGROUND

The statements herein merely provide background information related to the present application and do not necessarily constitute the conventional art.

With the increasingly wide application of displays, the demand of the modern society for displays is increasingly extensive. LCD (Liquid Crystal Display) and OLED (Organic Light-Emitting Diode) are commonly used as display elements in applications including mobile phones, monitors, laptop computers, tablet computers, televisions, and even some smart watches. It is known that for any display, the stability of the display effect is crucial. Flicker is a phenomenon which seriously affects the display quality, and the periodic changes of brightness caused by the incomplete symmetry between the anodic and cathodic pixel voltages not only affect the users' viewing experience, but also reduce the service life of products.

At present, the mainstream for adjusting the display brightness stability of an LCD by manufacturers in LCD industry is to determine the optimal common voltage of a product at 127 gray scale, so as to avoid the occurrence of flicker. As shown in FIG. 1, before the common voltage is adjusted, the anodic and cathodic pixel voltages are inconsistent, and the brightness in a period of 30 Hz is different; after the common voltage is adjusted, the anodic and cathodic pixel voltages are almost consistent, and the brightness in the period of 30 Hz is not obviously different.

The current methods for searching the optimal common voltage of 127 gray scales mainly include: the first method changing the common voltage for each LCD (Liquid Crystal Display) gradually by manual measurement, searching point-by-point until the minimum flicker is found, and thus determining the optimum value of the common voltage; the second method using an automatic device equipped with a optimal common voltage searching method to replace manual operation, in which, generally, the automated searching uses a point-by-point voltage ascending or descending manner to automatically search for the optimal common voltage.

However, the inventor realizes that the determination provided in the exemplary techniques depends on the manual point-by-point measurement, which is time- and labor-consuming and inefficient; in the exemplary techniques, the automatic measurement is conducted by a point-by-point voltage searching method, which requires a lot of time to search for the optimum voltage.

SUMMARY

In order to solve the problem of low efficiency, a method, a device, and a system for determining an actual option common voltage (Vcom) of a display panel are provided according to various embodiments disclosed in the present application.

A method for determining an actual option common voltage of a display panel is disclosed herein, in which the display panel includes a common electrode and a plurality of pixel electrodes arranged opposite to the common electrode, the common electrode is applied with a common voltage, each pixel electrode is applied with an anodic gray-scale voltage and a cathodic gray-scale voltage corresponding to the gray-scale value, and the method for determining the actual option common voltage includes:

acquiring a first common voltage and a second common voltage for fitting a curve, in which the first common voltage is not less than a theoretical optimal common voltage, the second common voltage is less than the theoretical optimal common voltage, and the theoretical optimal common voltage is a mean voltage of the anodic gray-scale voltage and the cathodic gray-scale voltage;

acquiring a first flicker corresponding to the first common voltage and a second flicker corresponding to the second common voltage;

acquiring a first Vcom-Flicker curve according to the first common voltage and the first flicker, and acquiring a second Vcom-Flicker curve according to the second common voltage and the second flicker; and determining a common voltage at an intersection of the first Vcom-Flicker curve and the second Vcom-Flicker curve, in which the common voltage at the intersection is the actual option common voltage.

Also disclosed herein is a device for determining an actual option common voltage of a display panel, in which the display panel includes a common electrode and a plurality of pixel electrodes arranged opposite to the common electrode, the common electrode is applied with a common voltage, each pixel electrode is applied with an anodic gray-scale voltage and a cathodic gray-scale voltage corresponding to the gray-scale value, and the device for determining the actual option common voltage includes:

a fitting voltage data acquisition circuit configured to acquire a first common voltage and a second common voltage for fitting a curve, in which the first common voltage is greater than a theoretical optimal common voltage, the second common voltage is less than the theoretical optimal common voltage, and the theoretical optimal common voltage is a mean voltage of the anodic gray-scale voltage and the cathodic gray-scale voltage;

a flicker acquisition circuit configured to acquire a first flicker corresponding to the first common voltage and a second flicker corresponding to the second common voltage;

a Vcom-Flicker fitting circuit configured to acquire a first Vcom-Flicker curve according to the first common voltage and the first flicker, and to acquire a second Vcom-Flicker curve according to the second common voltage and the second flicker; and an actual option common voltage determining circuit configured to determine a common voltage at an intersection of the first Vcom-Flicker curve and the second Vcom-Flicker curve, in which the common voltage at the intersection is the actual option common voltage.

Further disclosed herein is a system for determining an actual option common voltage of a display panel, including a common voltage measuring instrument, a color analyzer and a processor, in which the common voltage measuring instrument is configured to measure a common voltage of the display panel under test and send the same to the processor, and the color analyzer is configured to measured a flicker corresponding to the common voltage;

The processor is connected to the voltage measuring instrument and the color analyzer, and is configured to execute the following steps of a method for determining the actual option common voltage of the display panel:

acquiring a first common voltage and a second common voltage for fitting a curve, in which the first common voltage is not less than a theoretical optimal common voltage, the second common voltage is less than the theoretical optimal common voltage, and the theoretical optimal common voltage is a mean voltage of the anodic gray-scale voltage and the cathodic gray-scale voltage;

acquiring a first flicker corresponding to the first common voltage and a second flicker corresponding to the second common voltage;

acquiring a first Vcom-Flicker curve according to the first common voltage and the first flicker, and acquiring a second Vcom-Flicker curve according to the second common voltage and the second flicker; and determining a common voltage at an intersection of the first Vcom-Flicker curve and the second Vcom-Flicker curve, in which the common voltage at the intersection is the actual option common voltage.

The details of one or more embodiments of the present application are set forth in the accompanying drawings and the description below. Other features and advantages of the present application will be apparent from the specification, drawings and claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can obtain other drawings according to the drawings without any inventive labor.

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are merely illustrative of the present application and are not intended to limit the present application.

It should be noted that when an element is referred to as being "connected to" another element, it can be directly connected to the other element, or an intervening element may also be present. The terms "mounted", "one end", "the other end" and the like as used herein are for illustration purposes only.

Unless defined otherwise, all technical and scientific terms used herein have present the same meaning as commonly understood by one of ordinary skill in the art to which the present application belongs. The term used in the specification of the present disclosure herein is for the purpose of describing particular embodiments only and is not intended to be limiting of the present disclosure. As used herein, the term "and/or" includes any and all combinations of one or more of the associated listed items.

Figure 1:
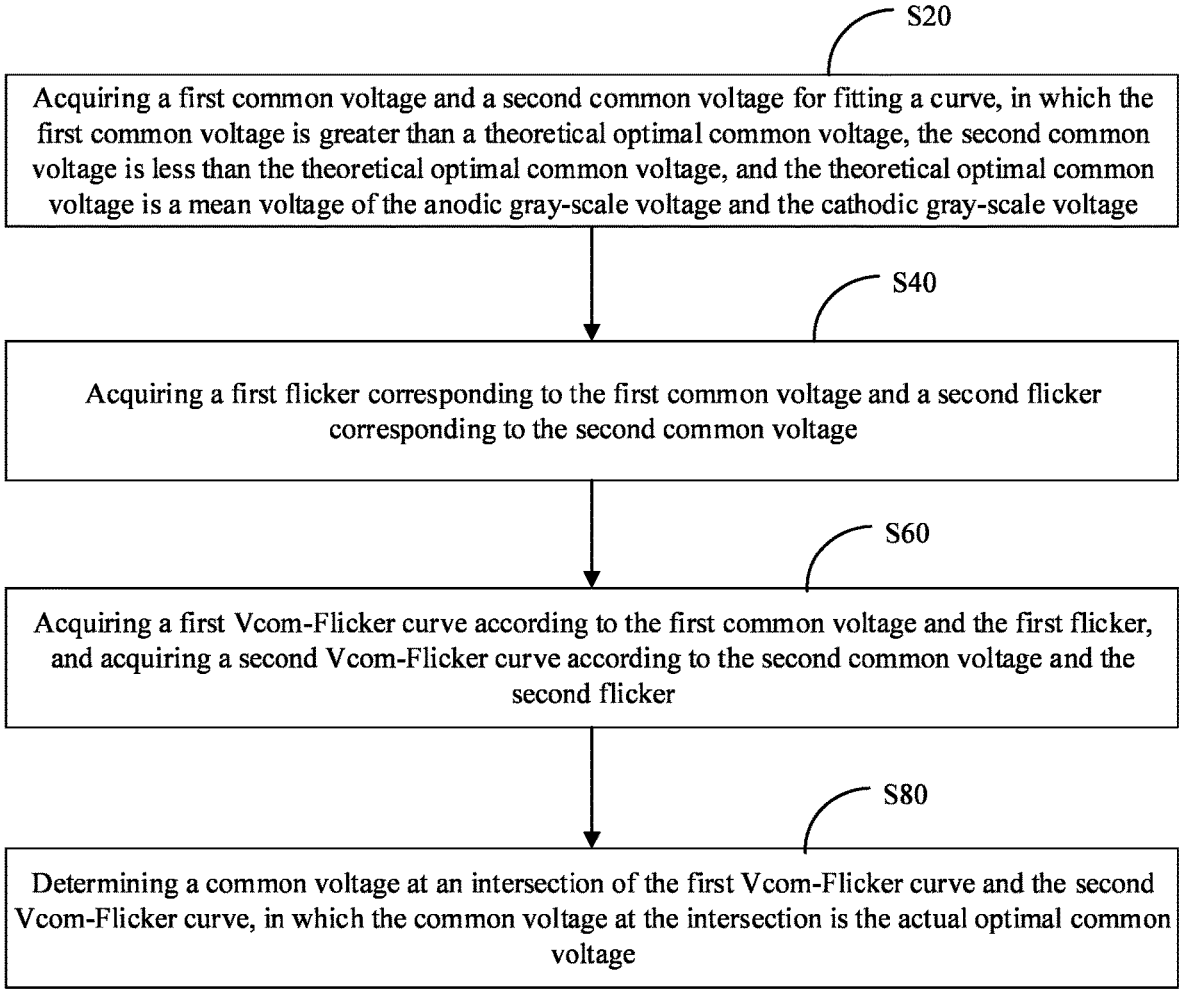
FIG. 1 is a schematic flow chart diagram of a method for determining an actual option common voltage of a display panel according to one or more embodiments.

In one aspect, one or more embodiments of the present disclosure provide a method for determining an actual option common voltage of a display panel, in which the display panel includes a common electrode and a plurality of pixel electrodes arranged opposite to the common electrode, the common electrode is applied with a common voltage, each pixel electrode is applied with an anodic gray-scale voltage and a cathodic gray-scale voltage corresponding to the gray-scale value, and as shown in FIG. 1, the method for determining the actual option common voltage includes:

S20: acquiring a first common voltage and a second common voltage for fitting a curve, in which the first common voltage is greater than a theoretical optimal common voltage, the second common voltage is less than the theoretical optimal common voltage, and the theoretical optimal common voltage is a mean voltage of the anodic gray-scale voltage and the cathodic gray-scale voltage;

S40: acquiring a first flicker corresponding to the first common voltage and a second flicker corresponding to the second common voltage;

S60: acquiring a first Vcom-Flicker curve according to the first common voltage and the first flicker, and acquiring a second Vcom-Flicker curve according to the second common voltage and the second flicker; and S80: determining a common voltage at an intersection of the first Vcom-Flicker curve and the second Vcom-Flicker curve, in which the common voltage at the intersection is the actual option common voltage.

During the research and development process, the inventor found a polynomial relationship between the common voltage of the display panel and the flicker corresponding to the common voltage through measurement and integration of a large amount of experiment data, and confirmed that the polynomial between the common voltage of the display panel under test and the flicker corresponding to the common voltage can be used to understand the changes in the flicker of the display panel under test along with the common voltage, and to rapidly determine the actual option common voltage. The actual option common voltage is the common voltage corresponding to the minimum flicker. With the actual option common voltage being the axis of symmetry, when gradually descending the common voltage leftward, the corresponding flicker gradually increases, and similarly, with the actual option common voltage being the axis of symmetry, when gradually ascending the common voltage rightward, the corresponding flicker gradually decreases. It should be noted that, as used herein, "left" of the actual option common voltage refers to the side on the common voltage axis where the portion less than or equal to the actual option common voltage is located, and similarly, "right" of the actual option common voltage refers to the side on the common voltage axis where the portion greater than or equal to the actual option common voltage is located.

A flicker is a value that reflects the flicker frequency of the screen when the display panel operates, and can be directly measured by a color analyzer. The theoretical optimal common voltage is a mean value of an anodic gray-scale voltage and a cathodic gray-scale voltage applied to a pixel electrode of the same sub-pixel at different times. The first Vcom-Flicker curve reflects the relationship between the common voltage on the right side of the actual option common voltage (greater than the actual option common voltage) and the corresponding flicker. The second Vcom-Flicker curve reflects the relationship between the common voltage on the left side of the actual option common voltage (less than the actual option common voltage) and the corresponding flicker.

Because the actual option common voltage is always less than the theoretical optimal common voltage, first common voltages greater than or equal to the theoretical optimal common voltage are acquired, and then first flickers corresponding to the first common voltage are acquired; data points corresponding to the first common voltages and the first flickers are fitted in a Vcom-Flicker coordinate system to give a first Vcom-Flicker curve reflecting the relationship between the first common voltage and the first flicker, thus determining the corresponding relationship between the common voltage on the right side of the actual option common voltage and the flicker. Similarly, a fitting polynomial also exists between the common voltage on the left side of the actual option common voltage and the flicker. Second common voltages greater than or equal to the theoretical optimal common voltage are acquired, and then second flickers corresponding to the second common voltage are acquired; data points corresponding to the second common voltages and the second flickers are fitted in a Vcom-Flicker coordinate system to give a second Vcom-Flicker curve reflecting the relationship between the common voltage on the left side of the actual option common voltage and the flicker. The first Vcom-Flicker curve and the second Vcom-Flicker curve are curves respectively on the right side and the left side of the axis of the actual option common voltage, and both curves pass through a point corresponding to the actual option common voltage, thus determining an intersection of the first Vcom-Flicker curve and the second Vcom-Flicker curve.

The flicker at the intersection is minimal, and the common voltage at the intersection is the actual option common voltage. The first Vcom-Flicker curve and the second Vcom-Flicker curve may be linear polynomial functions, quadratic polynomial functions or the like.

The method for determining the actual option common voltage of the display panel provided by one or more embodiment of the present disclosure selects a limited number of common voltages, determines a first Vcom-Flicker curve and a second Vcom-Flicker curve reflecting the relationship between the common voltage and the flicker, determines the actual option common voltage according to the characteristics of the first Vcom-Flicker curve and the second Vcom-Flicker curve, and thus can quickly determine the actual option common voltage, save time and labor, and improves the efficiency of determining the actual option common voltage. The method provided by one or more embodiment of the present disclosure can quickly determine the actual option common voltage of the 127 gray-scale display panel.

In one or more embodiments, the difference between the theoretical optimal common voltage and the second common voltage for fitting a curve is not less than 1 V.

In exploring process, the inventor found, through investigating a large amount of data, that for a 127 gray-scale display panel, the difference between the actual option common voltage and the theoretical optimal common voltage does not exceed 1 V. Therefore, when selecting the second common voltage, in order to ensure that the second common voltage is a common voltage value on the left side of the actual option common voltage and accuracy for fitting the second Vcom-Flicker curve is improved, the acquired second common voltages are at least 1 V less than the theoretical optimal common voltage, such that accuracy for determining the actual option common voltage is improved.

Figure 2:
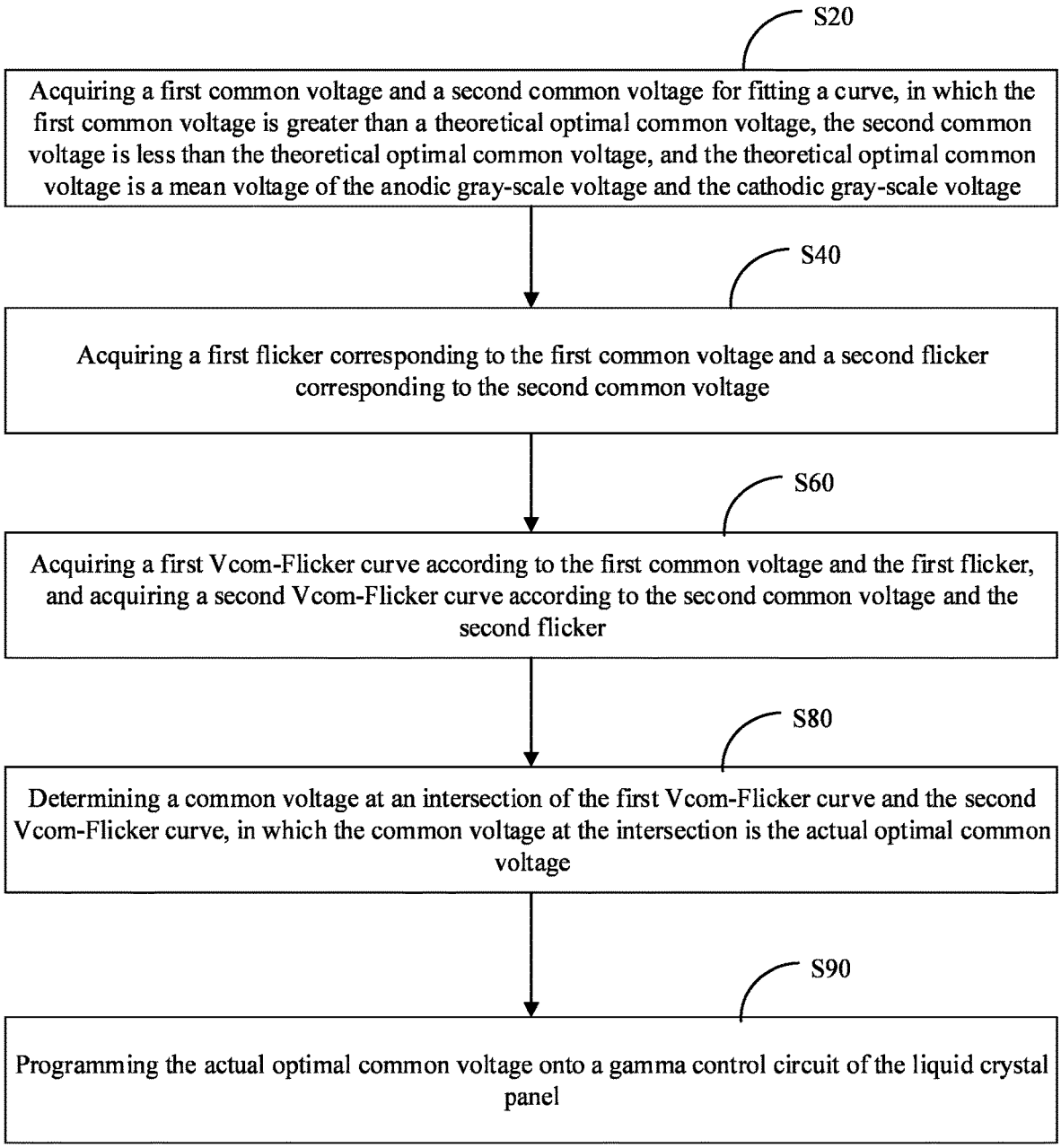
FIG. 2 is a schematic flow chart diagram of a method for determining an actual option common voltage of a display panel according to one or more embodiments.

In one or more embodiments, as shown in FIG. 2, the method for determining the actual option common voltage of the display panel further includes the step of:

programming the actual option common voltage onto a gamma control circuit of the display panel.

After the actual option common voltage is determined, the acquired actual option common voltage is programmed onto a gamma control circuit of the display panel to provide a proper common voltage for the display panel, such that the problem of screen flashing is avoided during the operation of the display panel. The gamma control circuit is a circuit for correcting a driving signal of the display panel in a liquid crystal display.

When the first common voltage and the first flicker are fitted, in the acquired first Vcom-Flicker curve:

$$y_{right}=a_1(x_1-b_1)^2+c_1$$

$x_1$ is a common voltage greater than the theoretical optimal common voltage, $y_{right}$ is a flicker corresponding to $x_1$, $a_1$ and $b_1$ are coefficients, and $c_1$ is a constant;

or in the first Vcom-Flicker curve:

$$y_{right}=k_1x_1+b_2$$

$x_1$ is a common voltage greater than the theoretical optimal common voltage, $y_{right}$ is a flicker corresponding to $x_1$, $k_1$ is a coefficient, and $b_2$ is a constant.

When the second common voltage and the second flicker are fitted, in the acquired second Vcom-Flicker curve:

$$y_{left}=a_2(x_2-b_3)^2+c_2$$

$x_2$ is a common voltage less than the theoretical optimal common voltage, $y_{left}$ is a flicker corresponding to $x_2$, $a_2$ and $b_3$ are coefficients, and $c_2$ is a constant;

or in the second Vcom-Flicker curve:

$$y_{left}=k_2x_2+b_4$$

$x_2$ is a common voltage less than the theoretical optimal common voltage, $y_{left}$ is a flicker corresponding to $x_2$, and $k_2$ and $b_4$ are parameters.

Different fitting results may affect the subsequent determination of intersection of the first Vcom-Flicker curve and the second Vcom-Flicker curve.

Figure 3:
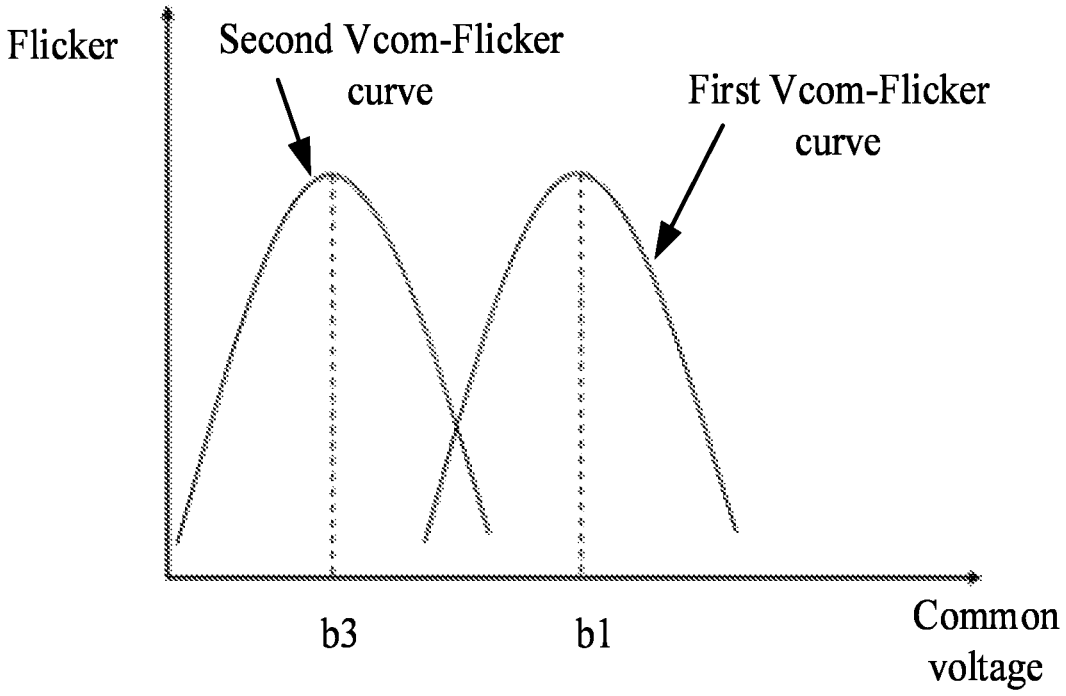
FIG. 3 is a schematic diagram illustrating the relationship between a first Vcom-Flicker curve and a second Vcom-Flicker curve according to one or more embodiments.

For example, when the first Vcom-Flicker curve by fitting is $y_{right}=a_1(x_1+b_1)^2+c_1$ and the second Vcom-Flicker curve is $y_{left}=a_2(x_2-b_3)^2+c_2$, as shown in FIG. 3, the first Vcom-Flicker curve corresponding to $a_1$, $b_1$, and $c_1$ can be determined by acquiring at least three first common voltages and corresponding first flickers, and similarly, the second Vcom-Flicker curve corresponding to $a_2$, $b_3$, and $c_2$ can be determined by acquiring at least three second common voltages and corresponding second flickers. Then the intersection of the two quadratic curves is calculated, and the common voltage at the intersection is the actual option common voltage. According to the method for determining the actual option common voltage of the display panel, provided by one or more embodiments of the disclosure, the actual option common voltage can be determined by selecting six common voltage values, which is fast and effective.

Figure 4:
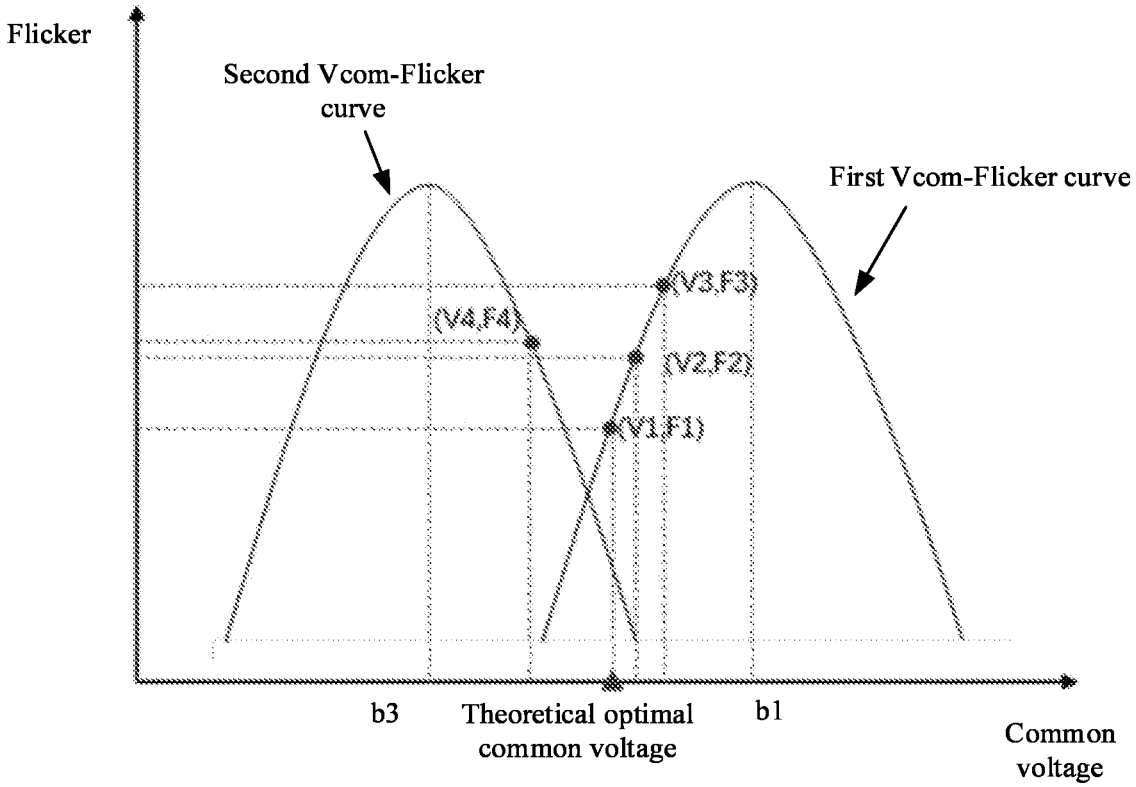
FIG. 4 is a schematic diagram illustrating the relationship between a first Vcom-Flicker curve and a second Vcom-Flicker curve according to one or more embodiments.

The inventor finds, through measuring a large amount of experimental data, that the fitted first Vcom-Flicker curve $y_{right}=a_1(x_1-b_1)^2+c_1$ and second Vcom-Flicker curve $y_{left}=a_2(x_2-b_3)^2+c_2$ are quadratic curves symmetric about the common voltage corresponding to the minimum flicker, i.e., $a_1=a_2=a$, and $c_1=c_3=c$. Therefore, as shown in FIG. 4, three first common voltages and their corresponding first flickers, and one second common voltage less than the theoretical optimal common voltage by 1 V and its corresponding second Flickers can be selected to determine the first Vcom-Flicker curve and the second Vcom-Flicker curve corresponding to a, $b_1$, $b_3$ and c. Then the actual option common voltage can be determined, and the determination of the actual option common voltage can be calculation of the common voltage corresponding to the intersection of the first Vcom-Flicker curve and the second Vcom-Flicker curve, i.e., calculating the fitting data point value where $y_{left}=y_{right}$ and $x_1=x_2$, thus giving the actual option common voltage.

Figure 5:
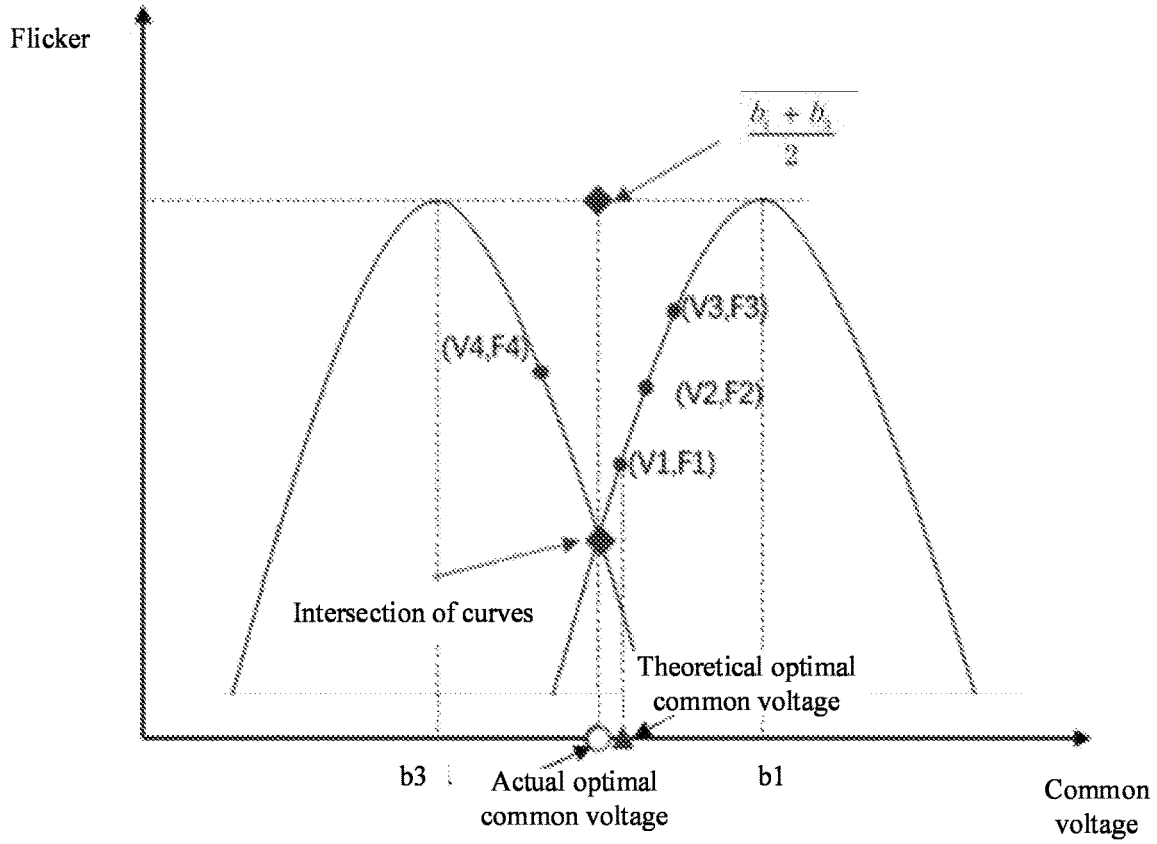
FIG. 5 is a schematic diagram illustrating the relationship between a first Vcom-Flicker curve and a second Vcom-Flicker curve according to one or more embodiments.

In another aspect, as shown in FIG. 5, since the Vcom-Flicker curve $y_{right}=a_1(x_1-b_1)^2+c_1$ and the second Vcom-Flicker curve $y_{left}=a_2(x_2-b_3)^2+c_2$ are quadratic curves symmetric about the common voltage corresponding to the minimum flicker, the actual option common voltage $$\text{Best } Vcom = \frac{b_1 + b_3}{2}$$

may also be determined by $b_1$ and $b_3$ corresponding to the vertexes of the two curves. According to the method for determining the actual option common voltage of the display panel, provided by one or more embodiments of the disclosure, the actual option common voltage can be determined by selecting four common voltage values, which is fast and effective.

Figure 6:
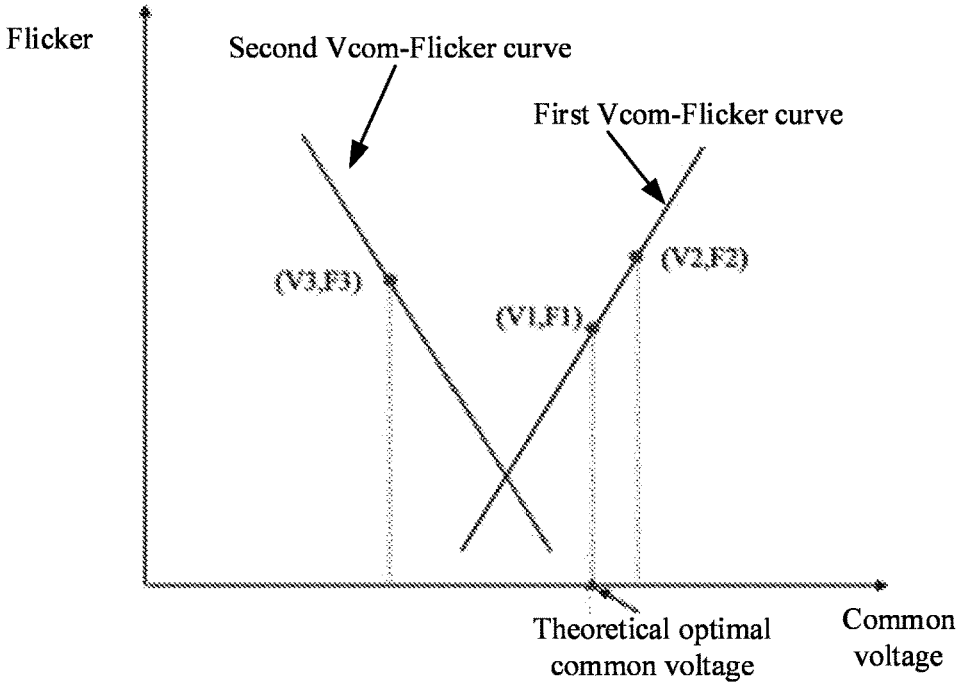
FIG. 6 is a schematic diagram illustrating the relationship between a first Vcom-Flicker curve and a second Vcom-Flicker curve according to one or more embodiments.

Furthermore, as shown in FIG. 6, when the first Vcom-Flicker curve by fitting is $y_{right}=k_1x_1+b_2$ and the second Vcom-Flicker curve is $y_{left}=k_2x_2+b_4$, the first Vcom-Flicker curve corresponding to $k_1$ and $b_2$ can be determined by acquiring at least two first common voltages and corresponding first flickers, and similarly, the second Vcom-Flicker curve corresponding to $k_2$ and $b_4$ can be determined by acquiring at least two second common voltages and corresponding second flickers. Then the intersection of the two linear curves is calculated, and the common voltage at the intersection is the actual option common voltage. According to the method for determining the actual option common voltage of the display panel, provided by one or more embodiments of the disclosure, the actual option common voltage can be determined by selecting four common voltage values, which is fast and effective.

Figure 7:
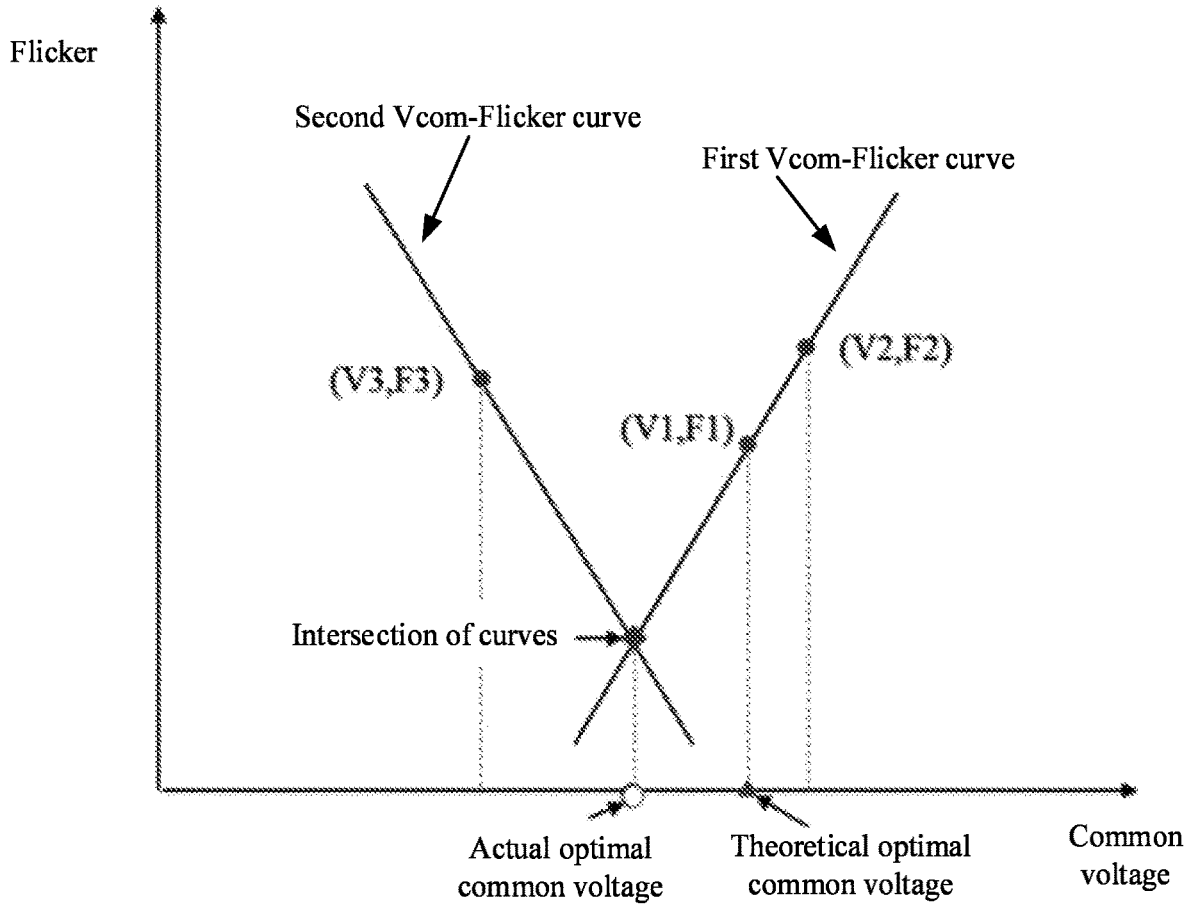
FIG. 7 is a schematic diagram illustrating the relationship between a first Vcom-Flicker curve and a second Vcom-Flicker curve according to one specific embodiment.

The inventor finds, through measuring a large amount of experimental data, that as shown in FIG. 7, the fitted first Vcom-Flicker curve $y_{right}=k_1x_1+b_2$ and second Vcom-Flicker curve $y_{left}=k_2\ x_2+b_4$ are linear curves symmetric about the common voltage corresponding to the minimum flicker, i.e., $k_1=k_2=k$. Therefore, two first common voltages and their corresponding first flickers, and one second common voltage less than the theoretical optimal common voltage by 1 V and its corresponding second Flickers can be selected to determine the first Vcom-Flicker curve and the second Vcom-Flicker curve corresponding to k, $b_2$ and $b_4$. Then the actual option common voltage can be determined by determining the intersection of the two curves.

Furthermore, when fitting the curves, the acquired first Vcom-Flicker curve may be $y_{right}=k_1x_1+b_2$, and the second Vcom-Flicker curve may be $y_{left}=a_2\ (x_2-b_3)^2+c_2$. the first Vcom-Flicker curve may be determined by acquiring at least two first common voltages and corresponding first flickers, and the second Vcom-Flicker curve may be determined by acquiring at least three second common voltages and corresponding second flickers. Then the actual option common voltage may be determined by calculating the intersection of the two curves.

Similarly, if the acquired first Vcom-Flicker curve is $y_{right}=a_1(x_1-b_1)^2+c_1$ and the second Vcom-Flicker curve is $y_{left}=k_2+b_4$, first Vcom-Flicker curve can be determined by acquiring at least three first common voltages and corresponding first flickers, and the second Vcom-Flicker curve can be determined by acquiring at least two second common voltages and corresponding second flickers. Then the actual option common voltage can be determined by calculating the intersection of the two curves.

It should be understood that although the various steps in the flow chart diagrams of FIGS. 1 and 2 are shown in order as indicated by the arrows, the steps are not necessarily performed in order as indicated by the arrows. The steps are not limited to being performed in the exact order illustrated and, unless explicitly stated herein, may be performed in other orders. Moreover, at least some of the steps in FIGS. 1 and 2 may include multiple sub-steps or multiple stages that are not necessarily performed at the same time, but may be performed at different times, and the sub-steps or stages are not necessarily performed sequentially, but may be performed in turn or alternately with other steps or at least some of the sub-steps or stages of other steps.

Figure 8:
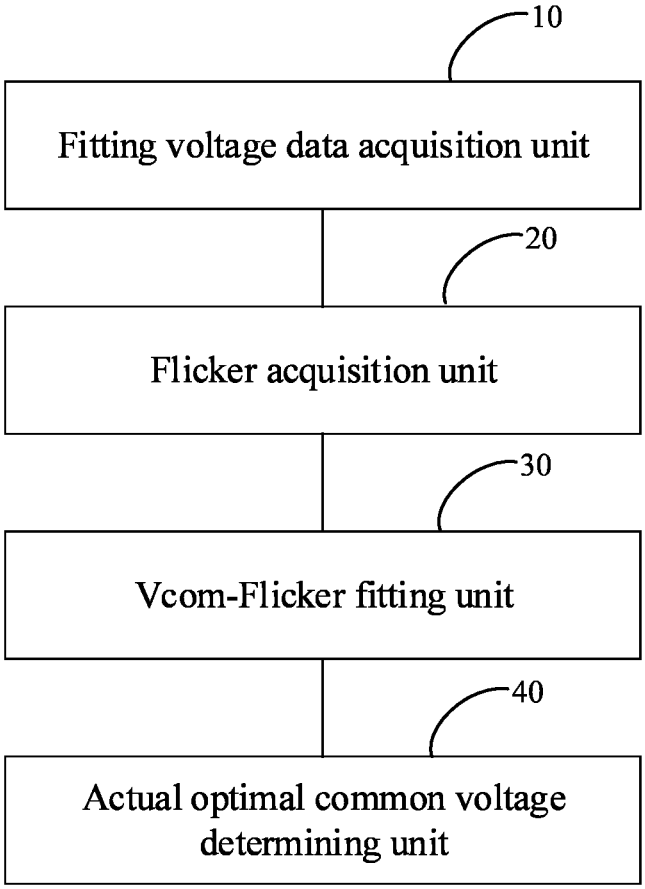
FIG. 8 is a schematic structure diagram of a device for determining an actual option common voltage of a display panel according to one or more embodiments.

In another aspect, one or more embodiments of the present disclosure provide a device for determining an actual option common voltage of a display panel, in which the display panel includes a common electrode and a plurality of pixel electrodes arranged opposite to the common electrode, the common electrode is applied with a common voltage, each pixel electrode is applied with an anodic gray-scale voltage and a cathodic gray-scale voltage corresponding to the gray-scale value, and as shown in FIG. 8, the device for determining the actual option common voltage includes:

a fitting voltage data acquisition circuit 10 configured to acquire a first common voltage and a second common voltage for fitting a curve, in which the first common voltage is greater than a theoretical optimal common voltage, the second common voltage is less than the theoretical optimal common voltage, and the theoretical optimal common voltage is a mean voltage of the anodic gray-scale voltage and the cathodic gray-scale voltage;

a flicker acquisition circuit 20 configured to acquire a first flicker corresponding to the first common voltage and a second flicker corresponding to the second common voltage;

a Vcom-Flicker fitting circuit 30 configured to acquire a first Vcom-Flicker curve according to the first common voltage and the first flicker, and acquiring a second Vcom-Flicker curve according to the second common voltage and the second flicker; and an actual option common voltage determining circuit 40 configured to determine a common voltage at an intersection of the first Vcom-Flicker curve and the second Vcom-Flicker curve, in which the common voltage at the intersection is the actual option common voltage.

The definitions of "first Vcom-Flicker curve" and other terms are the same as those of the above embodiments, and are not repeated hereinafter. Specifically, the fitting voltage data acquisition circuit 10 acquires the first common voltage and the second common voltage for fitting a curve and sends the same to the Vcom-Flicker fitting circuit 30; the flicker acquisition circuit 20 acquires the first flicker corresponding to the first common voltage and the second flicker corresponding to the second common voltage and sends the same to the Vcom-Flicker fitting circuit 30; then the Vcom-Flicker fitting circuit 30 acquires the first Vcom-Flicker curve according to the first common voltage and the first flicker, and acquires the second Vcom-Flicker curve according to the second common voltage and the second flicker; and the actual option common voltage determining circuit 40 determines the actual option common voltage at the intersection according to the first Vcom-Flicker curve and the second Vcom-Flicker curve.

In one or more embodiments, for the first Vcom-Flicker curve:

$$y_{right}=a_1(x_1-b_1)^2+c_1$$

$x_1$ is a common voltage greater than the theoretical optimal common voltage, $y_{right}$ is a flicker corresponding to $x_1$, $a_1$ and $b_1$ are coefficients, and $c_1$ is a constant.

In one or more embodiments, for the first Vcom-Flicker curve:

$$y_{right}=k_1x_1+b_2$$

$x_1$ is a common voltage greater than the theoretical optimal common voltage, $y_{right}$ is a flicker corresponding to $x_1$, $k_1$ is a coefficient, and $b_2$ is a constant.

For the specific definition of the device for determining the actual option common voltage of a display panel, see the definition of the method for determining the actual option common voltage of a display panel, which is not repeated hereinafter. The modules in the aforementioned device for determining the actual option common voltage of a display panel may be completely or partially implemented by software, hardware, and a combination thereof. The above modules can be a hardware incorporated in or independent of a processor in the computer device, and can also be stored in a memory in the computer device in the form of a software, such that the processor can call and execute operations corresponding to the modules.

Figure 9:
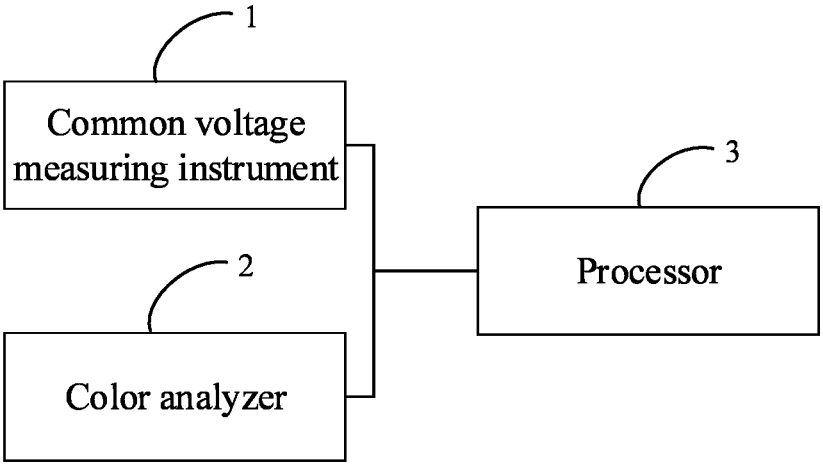
FIG. 9 is a schematic structure diagram of a system for determining an actual option common voltage of a display panel according to one or more embodiments.

A system for determining an actual option common voltage of a display panel as shown in FIG. 9, including a common voltage measuring instrument 1, a color analyzer 2 and a processor 3, in which the common voltage measuring instrument 1 is configured to measure a common voltage of the display panel under test and send the same to the processor 3, and the color analyzer 2 is configured to measured a flicker corresponding to the common voltage, and the processor 3 is connected to the voltage measuring instrument and the color analyzer 2 and is configured to execute the steps of the method described above for determining the actual option common voltage of the display panel.

In order to quickly determine the actual option common voltage, the common voltage measuring instrument 1 measures a first common voltage and a second common voltage applied to a common electrode and outputs data to the processor 3; at the same time, the color analyzer 2 acquires a first flicker corresponding to the first common voltage applied to the common electrode and a second Flicker corresponding to the second common voltage, and outputs the same to the processor 3; the processor 3 determines a first Vcom-Flicker curve according to the acquired first common voltage and the first flicker, and determines a second Vcom-Flicker curve according to the acquired second common voltage and the second flicker; then an intersection of the first Vcom-Flicker curve and the second Vcom-Flicker curve is calculated to determine the actual option common voltage. The system for determining the actual option common voltage of the display panel provided by one ore more embodiments of the disclosure can quickly determine the actual option common voltage.

In one or more embodiments, the color analyzer 2 is a CA310 color analyzer 2. The CA310 measures the flickers corresponding to the first common voltage and the second common voltage, and outputs the first flicker and the second flicker to the processor 3, so as to provide the processor 3 a data basis for determining the actual option common voltage.

Figure 10:
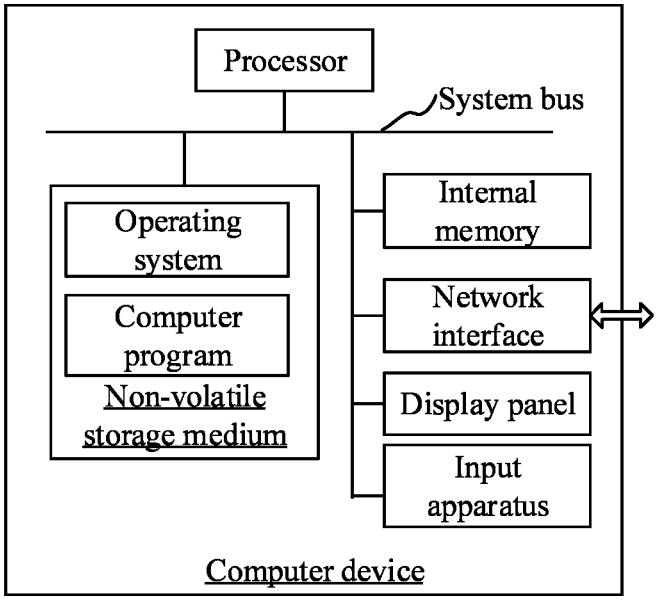
FIG. 10 is a diagram of an internal structure of a computer device according to an embodiment.

In one or more embodiments, a computer device is provided, which may be a terminal, and its internal structure diagram may be shown in FIG. 10. The computer device includes a processor, a memory, a network interface, a display screen and an input apparatus connected by a system bus. The processor of the computer device is used to provide computing and controlling capabilities. The memory of the computer device includes a non-volatile storage medium and an internal memory. The non-volatile storage medium stores an operating system and a computer program. The internal memory provides an environment for the operation of the operating system and the computer program in the non-volatile storage medium. The network interface of the computer device is configured to communicate with an external terminal through a network connection. The computer program is executed by a processor to implement a method for determining an actual option common voltage of a display panel. The display screen of the computer device can be an liquid crystal display screen or an electronic ink display screen, and the input apparatus of the computer device can be a touch layer covering the display screen, or a button, a track ball or a touch pad provided on the housing of the computer device, or an external keyboard, touch pad or mouse, and the like.

It will be understood by those skilled in the art that the structure shown in FIG. 10 is only a block diagram of part of structure associated with the present application, and is not intended to limit the computer device to which the present application may be applied, and that a specific computer device may include more or fewer components than shown in the FIG. 10, or may combine certain components, or have a different arrangement of components.

A computer device, including a memory and a processor, in which the memory stores a computer program, and the processor implements the following steps of the method when executing the computer program shown in FIG. 1:

S20: acquiring a first common voltage and a second common voltage for fitting a curve, in which the first common voltage is greater than a theoretical optimal common voltage, the second common voltage is less than the theoretical optimal common voltage, and the theoretical optimal common voltage is a mean voltage of the anodic gray-scale voltage and the cathodic gray-scale voltage;

S40: acquiring a first flicker corresponding to the first common voltage and a second flicker corresponding to the second common voltage;

S60: acquiring a first Vcom-Flicker curve according to the first common voltage and the first flicker, and acquiring a second Vcom-Flicker curve according to the second common voltage and the second flicker; and S80: determining a common voltage at an intersection of the first Vcom-Flicker curve and the second Vcom-Flicker curve, in which the common voltage at the intersection is the actual option common voltage.

In the computer device provided by one or more embodiments of the disclosure, when operating, the processor executes the program stored in the memory, and thus can quickly determine the actual option common voltage.

A computer-readable storage medium, on which a computer program is stored which, when executed by a processor, implements steps of the method as shown in FIG. 1:

S20: acquiring a first common voltage and a second common voltage for fitting a curve, in which the first common voltage is greater than a theoretical optimal common voltage, the second common voltage is less than the theoretical optimal common voltage, and the theoretical optimal common voltage is a mean voltage of the anodic gray-scale voltage and the cathodic gray-scale voltage;

S40: acquiring a first flicker corresponding to the first common voltage and a second flicker corresponding to the second common voltage;

S60: acquiring a first Vcom-Flicker curve according to the first common voltage and the first flicker, and acquiring a second Vcom-Flicker curve according to the second common voltage and the second flicker; and S80: determining a common voltage at an intersection of the first Vcom-Flicker curve and the second Vcom-Flicker curve, in which the common voltage at the intersection is the actual option common voltage.

It will be understood by those skilled in the art that all or part of the processes of the method of the embodiments described above may be implemented by instructing relevant hardware through a computer program, which may be stored in a non-volatile computer-readable storage medium, and when executed, may include the processes of the method of the embodiments described above. Any reference to memory, storage, database or other medium used in the embodiments provided herein can include non-volatile and/or volatile memory. Non-volatile memory can include read-only memory (ROM), programmable ROM (PROM), electrically programmable ROM (EPROM), electrically erasable programmable ROM (EEPROM), or flash memory. Volatile memory can include random-access memory (RAM) or external cache memory. By way of illustration and not limitation, RAM is available in a variety of forms such as static RAM (SRAM), dynamic RAM (DRAM), synchronous DRAM (SDRAM), double data rate SDRAM (DDRSDRAM), enhanced SDRAM (ESDRAM), synchronous link (Synchlink), synchronous link DRAM (SLDRAM), rambus direct RAM (RDRAM), direct rambus dynamic RAM (DRDRAM), and rambus dynamic RAM (RDRAM).

The technical features of the above embodiments can be combined arbitrarily. For the sake of brevity, all possible combinations of the technical features of the above embodiments are not described, and such combinations of the technical features shall be deemed to fall within the scope of the present disclosure as long as there is no contradiction.

The embodiments above only describe several implementations of the present disclosure, and the description thereof is specific and detailed. However, those cannot be therefore construed as limiting the scope of the disclosure. It should be noted that, for those of ordinary skill in the art, several variations and modifications can be made without departing from the concept of the present disclosure, which also fall within the scope of the present disclosure. Therefore, the protection scope of the present disclosure shall be defined by the appended claims.

What is claimed is:

1. A method for determining an actual optimal common voltage of a display panel, wherein the display panel comprises a common electrode and a plurality of pixel electrodes arranged opposite to the common electrode, wherein the common electrode is applied with a common voltage, each of the pixel electrodes is applied with a positive gray-scale voltage or a negative gray-scale voltage corresponding to a gray-scale value, and the method for determining the actual optimal common voltage comprises:

acquiring a first common voltage and a second common voltage for fitting a curve, wherein the first common voltage is not less than a theoretical optimal common voltage, the second common voltage is less than the theoretical optimal common voltage, wherein the theoretical optimal common voltage is a mean voltage of the positive gray-scale voltage and the negative gray-scale voltage;

acquiring a first flicker value corresponding to the first common voltage and a second flicker value corresponding to the second common voltage;

acquiring a first Vcom-Flicker curve based on the first common voltage and the first flicker value, and acquiring a second Vcom-Flicker curve based on the second common voltage and the second flicker value; and determining a common voltage at an intersection of the first Vcom-Flicker curve and the second Vcom-Flicker curve, wherein the common voltage at the intersection is the actual optimal common voltage;

wherein the first Vcom-Flicker curve is a quadratic polynomial function $y_{right}=a_1(x_1-b_1)^2+c_1$ or a linear polynomial function $y_{right}=k_1x_1+b_2$; where in the quadratic polynomial function $y_{right}=a_1(x_1-b_1)^2+c_1$, $x_1$ represents the common voltage greater than the theoretical optimal common voltage, and $y_{right}$ represents a flicker corresponding to $x_1$, where $a_1$ and $b_1$ are coefficients, and $c_1$ is a constant; and where in the linear polynomial function $y_{right}=k_1x_1+b_2$, $x_1$ represents the common voltage greater than the theoretical optimal common voltage, and $y_{right}$ represents the flicker corresponding to $x_1$, where $k_1$ is a coefficient, and $b_2$ is a constant; and wherein the second Vcom-Flicker curve is a quadratic polynomial function $y_{left}=a_2(x_2-b_3^2+c_2$, or a linear polynomial function $y_{left}=k_2x_2+b_4$; where in the quadratic polynomial function $y_{left}=a_2(x_2-b_3^2+c_2$, $x_2$ represents the common voltage less than the theoretical optimal common voltage, and $y_{left}$ represents a flicker corresponding to $x_2$, where $a_2$ and $b_3$ are coefficients, and $c_2$ is a constant; and where in the linear polynomial function $y_{left}=k_2x_2+b_4$, $x_2$ represents the common voltage less than the theoretical optimal common voltage, $y_{left}$ represents a flicker corresponding to $x_2$, and where $k_2$ and $b_4$ are parameters;

wherein acquiring the first Vcom-Flicker curve based on the first common voltage and the first flicker value comprises: when the first Vcom-Flicker curve is the quadratic polynomial function $y_{right}=a_1(x_1-b_1)^2+c_1$, acquiring at least three actual first common voltages and corresponding actual first flicker values to determine the fitted first Vcom-Flicker curve corresponding to a, $b_1$, and $c_1$; and when the first Vcom-Flicker curve is the linear polynomial function $y_{right}=k_1x_1+b_2$, acquiring at least two first common voltages and corresponding first flicker values to determine the fitted first Vcom-Flicker curve corresponding to $k_1$ and $b_2$;

wherein acquiring the second Vcom-Flicker curve based on the second common voltage and the second flicker value comprises: when the second Vcom-Flicker curve is the quadratic polynomial function $y_{left}=a_2(x_2-b_3{}^2+c_2$, acquiring at least three actual second common voltages and corresponding actual second flicker values to determine the fitted second Vcom-Flicker curve corresponding to $a_2$, $b_2$, and $c_2$; and when the second Vcom-Flicker curve is the linear polynomial function $y_{left}=k_2x_2+b_4$, acquiring at least two second common voltages and corresponding second flicker values to determine the fitted second Vcom-Flicker curve corresponding to $k_2$ and $b_4$;

wherein at least one selected from the group of the first Vcom-Flicker curve and the second Vcom-Flicker curve is a quadratic polynomial function.

2. The method for determining the actual optimal common voltage of the display panel according to claim 1, wherein the difference between the theoretical optimal common voltage and each of the at least two second common voltage for fitting a curve in the case where the second Vcom-Flicker curve is the linear polynomial function $y_{left}=k_2x_2+b_4$ is not less than 1V, or wherein the difference between the theoretical optimal common voltage and each of the at least two second common voltage for fitting a curve in the case where the second Vcom-Flicker curve is the quadratic polynomial function $y_{left}=a_2(a_2-b_3)^2+c_2$ is not less than 1V.

3. A system for determining an actual optimal common voltage of a display panel, comprising a common voltage measuring instrument, a color analyzer and a processor, wherein the common voltage measuring instrument is configured to measure a common voltage of the display panel under test and send the same to the processor, and the color analyzer is configured to measured a flicker corresponding to the common voltage; the display panel comprises a common electrode and a plurality of pixel electrodes arranged opposite to the common electrode, the common electrode is applied with a common voltage, and each of the pixel electrodes is applied with a positive gray-scale voltage or a negative gray-scale voltage corresponding to a gray-scale value;

the processor is connected to the voltage measuring instrument and to the color analyzer, and is configured to execute the following:

acquiring a first common voltage and a second common voltage for fitting a curve, wherein the first common voltage is not less than a theoretical optimal common voltage, the second common voltage is less than the theoretical optimal common voltage, wherein the theoretical optimal common voltage is a mean voltage of the positive gray-scale voltage and the negative gray-scale voltage;

acquiring a first flicker value corresponding to the first common voltage and a second flicker value corresponding to the second common voltage;

acquiring a first Vcom-Flicker curve based on the first common voltage and the first flicker value, and acquiring a second Vcom-Flicker curve based on the second common voltage and the second flicker value; and determining a common voltage at an intersection of the first Vcom-Flicker curve and the second Vcom-Flicker curve, wherein the common voltage at the intersection is the actual optimal common voltage;

wherein the first Vcom-Flicker curve is a quadratic polynomial function $y_{right}=a_1(x_1-b_1)^2+c_1$ or a linear polynomial function $y_{right}=k_1x_1+b_2$; where in the quadratic polynomial function $y_{right}=a_1(x_1-b_1)^2+c_1$, $x_1$ represents the common voltage greater than the theoretical optimal common voltage, and $y_{right}$ represents a flicker corresponding to $x_1$, where $a_1$ and $b_1$ are coefficients, and $c_1$ is a constant; and where in the linear polynomial function $y_{right}=k_1x_1+b_2$, $x_1$ represents the common voltage greater than the theoretical optimal common voltage, and $y_{right}$ represents the flicker corresponding to $x_1$, where $k_1$ is a coefficient, and $b_2$ is a constant; and wherein the second Vcom-Flicker curve is a quadratic polynomial function $y_{left}=a_2(x_2-b_3{}^2+c_2$, or a linear polynomial function $y_{left}=k_2x_2+b_4$; where in the quadratic polynomial function $y_{left}=a_2(x_2-b_3{}^2+c_2$, $x_2$ represents the common voltage less than the theoretical optimal common voltage, and $y_{left}$ represents a flicker corresponding to $x_2$, where $a_2$ and $b_3$ are coefficients, and $c_2$ is a constant; and where in the linear polynomial function $y_{left}=k_2x_2+b_4$, $x_2$ represents the common voltage less than the theoretical optimal common voltage, $y_{left}$ represents a flicker corresponding to $x_2$, and where $k_2$ and $b_4$ are parameters;

wherein acquiring the first Vcom-Flicker curve based on the first common voltage and the first flicker value comprises: when the first Vcom-Flicker curve is the quadratic polynomial function $y_{right}=a_1(x_1-b_1)^2+c_1$, acquiring at least three actual first common voltages and corresponding actual first flicker values to determine the fitted first Vcom-Flicker curve corresponding to $a_1$, $b_1$, and $c_1$; and when the first Vcom-Flicker curve is the linear polynomial function $y_{right}=k_1x_1+b_2$, acquiring at least two first common voltages and corresponding first flicker values to determine the fitted first Vcom-Flicker curve corresponding to $k_1$ and $b_2$;

wherein acquiring the second Vcom-Flicker curve based on the second common voltage and the second flicker value comprises: when the second Vcom-Flicker curve is the quadratic polynomial function $y_{left}=a_2(x_2-b_3)^2+c_2$, acquiring at least three actual second common voltages and corresponding actual second flicker values to determine the fitted second Vcom-Flicker curve corresponding to $a_2$, $b_2$, and $c_2$; and when the second Vcon-Flicker curve is the linear polynomial function $y_{left}=k_2x_2+b_2$, acquiring at least two second common voltages and corresponding second flicker values to determine the fitted second Vcom-Flicker curve corresponding to $k_2$ and $b_4$;

wherein at least one selected from the group of the first Vcom-Flicker curve and the second Vcom-Flicker curve is a quadratic polynomial function.

4. A method for determining an actual optimal common voltage of a display panel, wherein the display panel comprises a common electrode and a plurality of pixel electrodes arranged opposite to the common electrode, wherein the common electrode is applied with a common voltage, each of the pixel electrodes is applied with a positive gray-scale voltage or a negative gray-scale voltage corresponding to a gray-scale value, and the method for determining the actual optimal common voltage comprises:

acquiring a first common voltage and a second common voltage for fitting a curve, wherein the first common voltage is not less than a theoretical optimal common voltage, the second common voltage is less than the theoretical optimal common voltage, wherein the theoretical optimal common voltage is a mean voltage of the positive gray-scale voltage and the negative gray-scale voltage;

acquiring a first flicker value corresponding to the first common voltage and a second flicker value corresponding to the second common voltage;

acquiring a first Vcom-Flicker curve based on the first common voltage and the first flicker value, and acquiring a second Vcom-Flicker curve based on the second common voltage and the second flicker value; and determining a common voltage at an intersection of the first Vcom-Flicker curve and the second Vcom-Flicker curve, wherein the common voltage at the intersection is the actual optimal common voltage;

wherein the first Vcom-Flicker curve is a linear polynomial function $y_{right}k_1x_1+b_2$; where in the linear polynomial function $y_{right}=k_1x_1+b_2$, $x_1$ represents the common voltage greater than the theoretical optimal common voltage, and $y_{right}$ represents the flicker corresponding to $x_1$, where $k_1$ is a coefficient, and $b_2$ is a constant; and wherein the second Vcom-Flicker curve is a linear polynomial function $y_{left}=k_2x_2+b_4$; where in the linear polynomial function $y_{left}=k_2x_2+b_4$, $x_2$ represents the common voltage less than the theoretical optimal common voltage, $y_{left}$ represents a flicker corresponding to $x_2$, and where $k_2$ and $b_4$ are parameters;

wherein acquiring the first Vcom-Flicker curve based on the first common voltage and the first flicker value comprises acquiring at least two first common voltages and corresponding first flicker values to determine the fitted first Vcom-Flicker curve corresponding to $k_1$ and $b_2$;

wherein acquiring the second Vcom-Flicker curve based on the second common voltage and the second flicker value comprises acquiring at least two second common voltages and corresponding second flicker values to determine the fitted second Vcom-Flicker curve corresponding to $k_2$ and $b_4$.

5. The method according to claim 1, wherein when the first Vcom-Flicker curve is the quadratic polynomial function $y_{right}=a_1(x_1-b_1)^2+c_1$ and the second Vcom-Flicker curve is the quadratic polynomial function $y_{left}=a_2(x_2-b_3)^2+c_2$, the actual optimal common voltage is alternatively determined by $b_1$ and $b_3$ corresponding to the vertexes of the two curves according to the following formula:

$$\text{Best } Vcom = \frac{b_1 + b_3}{2}.$$

* * * * *